US006250598B1

(12) United States Patent
Maier-Hunke

(10) Patent No.: US 6,250,598 B1
(45) Date of Patent: Jun. 26, 2001

(54) HOLDER FOR SWIVELLING PANELS OR THE LIKE

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 0 days.

(21) Appl. No.: 09/194,813

(22) PCT Filed: Jun. 2, 1997

(86) PCT No.: PCT/DE97/01156

§ 371 Date: Dec. 2, 1998

§ 102(e) Date: Dec. 2, 1998

(87) PCT Pub. No.: WO97/48088

PCT Pub. Date: Dec. 18, 1997

(30) Foreign Application Priority Data

Jun. 7, 1996 (DE) ..... 196 23 904

(51) Int. Cl.[7] ..... A47B 19/00

(52) U.S. Cl. ..... 248/441.1; 40/510; 248/447.1

(58) Field of Search ..... 248/441.1, 447, 248/447.1, 450, 451, 452, 453, 458; 40/492, 510, 398, 475

(56) References Cited

U.S. PATENT DOCUMENTS

| | | | | |
|---|---|---|---|---|
| 1,866,089 | * | 7/1932 | Day | 40/398 |
| 2,138,848 | * | 12/1938 | Ralston et al. | 40/404 |
| 2,617,219 | * | 11/1952 | Conley et al. | 211/169 |
| 3,092,256 | * | 6/1963 | Vernik | 211/40 |
| 3,412,496 | * | 11/1968 | Hendricks et al. | 40/389 |
| 3,514,883 | * | 6/1970 | Albright | 40/492 |
| 4,403,761 | | 9/1983 | Jamar | 248/441 B |
| 4,456,286 | * | 6/1984 | Jamar | 248/452 X |
| 4,684,099 | | 8/1987 | Krapf | 248/447.1 |
| 4,831,758 | * | 5/1989 | Williams et al. | 40/510 |
| 5,031,346 | * | 7/1991 | Herring et al. | 40/463 |
| 5,077,923 | * | 1/1992 | Rockola et al. | 40/510 |
| 5,222,611 | * | 6/1993 | Wood et al. | 211/94 |

* cited by examiner

*Primary Examiner*—Anita M. King
*Assistant Examiner*—Tan Le
(74) *Attorney, Agent, or Firm*—Mark P. Stone

(57) ABSTRACT

A holder for swivelling panels, flip boards, or the like, particularly used as a wall holder, is injection molded in a single piece. The rear wall of the shell-shaped base body of the holder is provided with windows in the area of pins for receiving swivelling panels in order to enable the holder to be produced in a single operation and by using an injection molding tool having only a top part and a bottom part.

5 Claims, 2 Drawing Sheets

HOLDER FOR SWIVELLING PANELS OR THE LIKE

BACKGROUND OF THE INVENTION

The invention relates to a holder, in particular a wall holder, for flip boards and flip pockets and flip sheaths which are provided in the region of the upper and lower end of one of their edges with swivel bearings for pins arranged in each case in a row at the upper and lower edge of the holder.

Holders of the above type are widely used, in particular in offices, laboratories, workshops and supermarkets. They are easy to manipulate and permit the user rapid access to information contained in subject indexes, lists, standard sheets, price lists and similar documents. Holders of the type described are known which comprise a metal basic body and plastic injection-molded parts connected thereto by rivets, the injection-molded parts being provided with a row of pins in each case. The reasons for the multipartite design of the known holders are to be found in the fact that an attempt was being made, on the one hand, to ensure the stability of the holder by means of its metal basic body and, on the other hand, to keep the costs for producing the rows of pins within reasonable bounds.

SUMMARY OF THE INVENTION

It is the object of the invention to provide a holder of the type under consideration whose basic body can be produced in one work operation together with the rows of pins, and which meets high demands with regard both to its stability and to its production costs. This object is achieved according to the invention by virtue of the fact that the holder has a shell-shaped basic body constructed as an injection-molded part and with a rear wall which is provided in the region of the pins with windows whose height is greater than the length and whose breadth is greater than the diameter of the pins, one edge of each window being aligned in each case with the inside of an end wall of the basic body bearing the pins of in each case one row of pins.

The holder according to the invention offers the advantage that, in conjunction with accessories formed by roller-shaped inserts, it can be more effectively adapted than known holders to spatial and application-specific features. The use of clamping jaws for holding the inserts permits not only rapid and convenient attachment as well as exchange of said inserts, but also, in the case of the use of the holder in conjunction with holding columns, permits the height and/or angular position of the holder with respect to the holding columns to be set in a fashion adapted to the respective situation.

BRIEF DESCRIPTION OF THE DRAWINGS

Further details and features of the invention follow from the subclaims and the following description of a particularly advantageous embodiment represented in the attached drawing, in which:

DESCRIPTION OF THE BEST MODES FOR CARRYING OUT THE INVENTION

Figure 1:
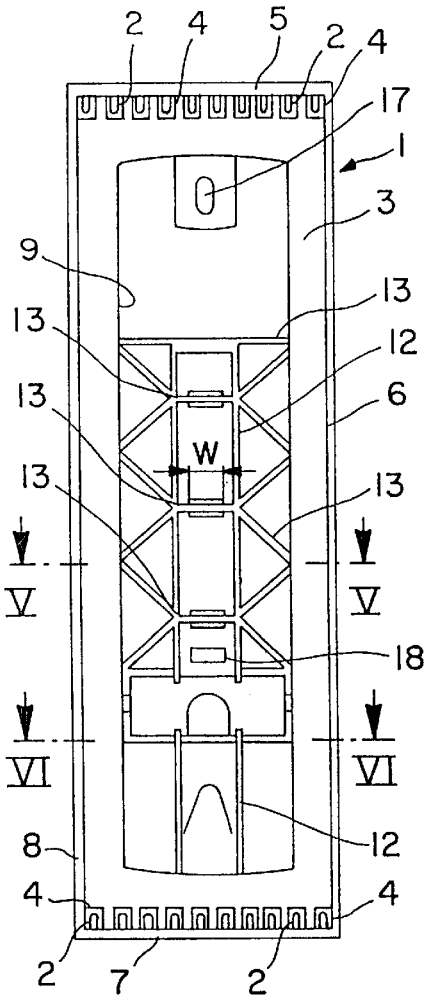
FIG. 1 is a front elevation view of a holder in accordance with the present invention.
Figure 2:
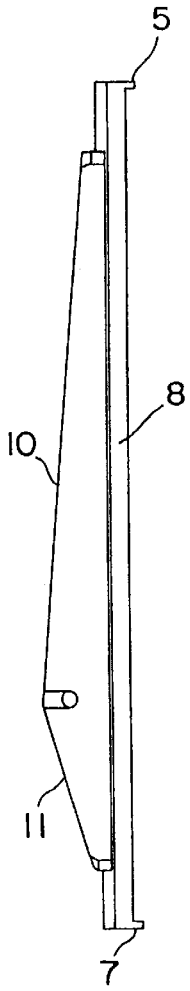
FIG. 2 is a side elevational view of the holder in accordance with FIG. 1.
Figure 3:
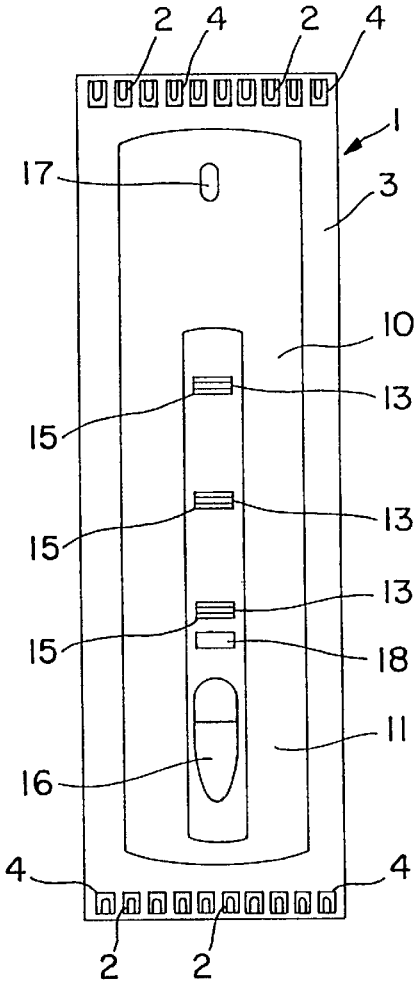
FIG. 3 is a rear elevational view of the holder in accordance with FIG. 1.
Figure 4:
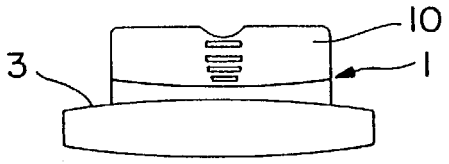
FIG. 4 is a top plan view of the holder in accordance with FIG. 1.
Figure 5:
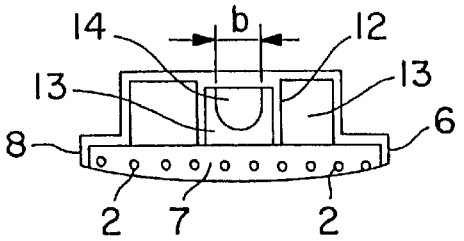
FIG. 5 shows a cross section of the holder in the region of the V—V in FIG. 1.
Figure 6:
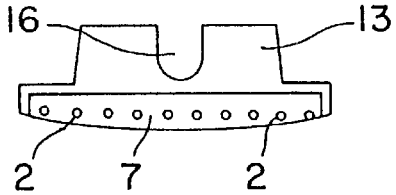
FIG. 6 shows a cross section of the holder in the region of the line VI—VI in FIG. 1
Figure 7:
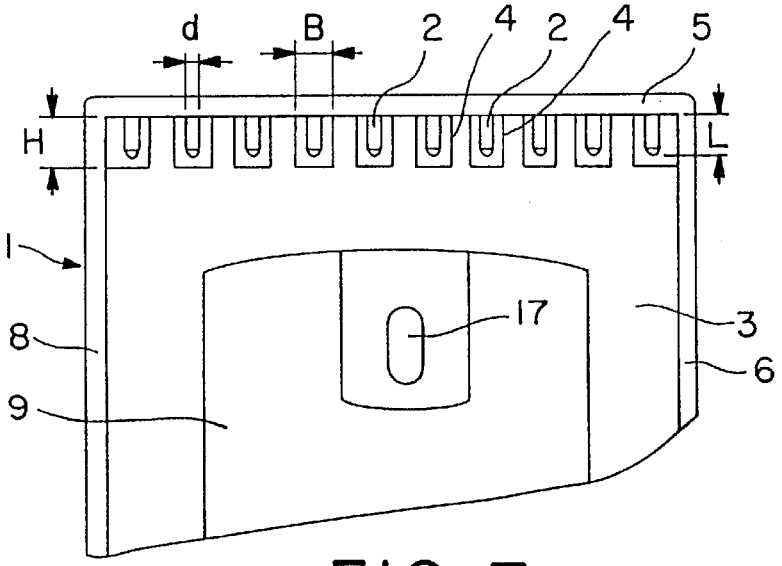
FIG. 7 shows the upper part of FIG. 1 on an enlarged scale.

In the FIGS, 1 denotes the basic body of a holder for known (and therefore not represented) swivel boards which are provided at mutually opposite ends of one of their edges with swivel bearings for rows of pins 2 arranged at the upper and lower edge of the holder. The holder shown has ten pairs of pins, and is therefore suitable for holding ten swivel boards which are constructed, for example, as scale-type boards. In order to permit cost-effective production of the holder, which is constructed as a plastic injection-molded part, its rear wall 3 is provided in the region of the pins 2 with windows 4 which permit the insertion of injection molded without splits. In order to lend the holder a satisfactory stability, it is of shell-shaped construction. It has end and side walls 5, 6, 7 and 8, constructed from a continuous web, and a central trough 9. In the region of the trough 9, the rear wall of the holder comprises two wall sections 10 and 11 which merge into one another in the lower third of the holder with the formation of an obtuse angle. Longitudinal struts 12 and transverse struts 13 in the region of the trough 9 make a considerable contribution to the stability of the holder. Four transverse struts 13 arranged in the centre of the trough 9 and running perpendicular to the longitudinal axis of the holder are provided with aligned plug-through openings 14 which permit a holding column to be pushed into the trough 9. Ten windows 15 are located in the wall section, in order also to be able to produce these cutouts cost-effectively. A guide channel 16 for a holding column is let into the wall section 11. As may be seen from FIGS. 1, 5 and 7, the height H of the window 4 is greater than the length 1, and the breadth B of the window 4 is greater than the diameter d of the pins 2. By contrast, the width W of the window 15 is equal to the breadth b of the cutouts 14.

In order to be able to fasten the holder on a wall with the aid of screws, the wall section 10 is fitted with cutouts 17 and 18 which are formed by elongated holes and whose longitudinal axes are perpendicular to one another, in order to be able to adjust the position of the holder within certain limits.

What is claimed is:

1. A holder for flip boards, flip pockets, or flip sheaths which are provided at upper and lower ends thereof with swivel bearing for pins, wherein the holder has a shell-shaped basic body (1) and a plurality of pins (2), each of said pins having a length (1) and a diameter (d), said basic body constructed as an injection-molded part and with a rear wall (3) which is provided with a plurality of windows (4), each said window having a height (H) greater than the length of said pin and a breadth (B) greater than the diameter (d) of said pin, said basic body (1) having opposed side walls (6, 8) and opposed end walls (5, 7) extending from said rear wall (3), each said end walls having one row of said pins (2), each said window (4) having one edge aligned with the inside of an adjacent one of said end walls (5, 7) of the basic body (1) bearing one of said rows of pins (2).

2. Holder according to claim 1, wherein said shell-shaped basic body (1) has said side walls (6, 8) arranged with said end walls (5, 7) to define a perimeter of said basic body, and a central trough (9) between said end and side walls.

3. Holder according to claim 2, wherein the basic body (1) is fitted with longitudinal and transverse struts (12, 13) proximate to said central trough (9) for providing reinforcement.

4. Holder according to claim 3, wherein a portion of at least one of said transverse struts (13) is provided with a cutout (14) having a breadth (b) to which a window (15) in the rear wall of the basic body (1) is assigned, each said window having a width (W), and each said cutout (14) having a breadth (b) equal to said width (W).

5. Holder according to claim 1, wherein said holder includes means (17, 18) for mounting said holder to a wall.

* * * * *